US006274082B1

(12) United States Patent
Nagahora et al.

(10) Patent No.: US 6,274,082 B1
(45) Date of Patent: Aug. 14, 2001

(54) PROCESS FOR PRODUCING SHAPED ARTICLE

(75) Inventors: Junichi Nagahora; Koju Tachi; Koji Saito, all of Sendai; Teruaki Onogi, Miyagi, all of (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/388,925

(22) Filed: Sep. 2, 1999

(30) Foreign Application Priority Data

Sep. 3, 1998 (JP) ..... 10-249737

(51) Int. Cl.[7] ..... B22F 3/02; B22F 3/10; B22F 3/20; B22F 7/02; B22F 1/02

(52) U.S. Cl. ..... 419/5; 419/6; 419/7; 419/8; 419/9; 419/12; 419/13; 419/14; 419/19; 419/35

(58) Field of Search ..... 419/5, 6, 8, 10, 419/7, 9, 12, 13, 14, 19, 35

(56) References Cited

U.S. PATENT DOCUMENTS 4,630,692 * 12/1986 Ecer ..... 175/330

5,967,248 * 10/1999 Drake et al. ..... 175/425

* cited by examiner

*Primary Examiner*—Daniel Jenkins
(74) *Attorney, Agent, or Firm*—Finnegan, Henderson, Farabow, Garrett & Dunner, L.L.P.

(57) ABSTRACT

A process for producing a shaped article, comprising: preparing a first powder having high strength and rigidity after completion of forming, and a second powder having abrasion resistance and surface hardness after completion of forming; compacting those powders to provide a forming material comprising a base part comprising the first powder and a supplemental part comprising the second powder; and forming the forming material into a shaped article by plastic processing, thereby producing a shaped article in which the base part and the supplemental part have different characteristics. The first powder preferably comprises a rapidly-solidified alloy powder and the second powder preferably comprises at least one member selected from among $Al_2O_3$, $Si_3N_4$, BN, SiC, $Al_4C_3$, $Al_8B_2O_{15}$ and $B_2O$ or a mixture of the member and the first powder which may be the same one actually used as the first powder or another one having a different compositions from that of the actually used first powder. The resultant shaped alloy material has an advantageous combination of plural excellent properties, such as high strength and abrasion resistance.

8 Claims, 1 Drawing Sheet

PROCESS FOR PRODUCING SHAPED ARTICLE

BACKGROUND OF THE INVENTION

1. Field of the Invention

The present invention relates to a process for producing a shaped article, and more particularly, to a process for producing an aluminum alloy shaped article that has an advantageous combination of plural excellent properties, such as strength, rigidity, abrasion resistance and surface hardness, and can be used in a wide field, such as structural materials and members for machines, structural materials and members for automobiles, and members for sport goods.

2. Description of the Prior Art

Various improvements have conventionally been made on an aluminum alloy for the purpose of improving its strength, heat resistance, abrasion resistance, rigidity and the like. Of those improved materials, particle- or fiber-reinforced composite materials, powder metallurgical materials produced, for example, by rapid-solidification, mechanical alloying or the like, are the representative examples thereof. However, those materials have the problems that if strength, abrasion resistance, heat resistance and the like are improved, toughness decreases, and if the concentration or volume rate of various alloying elements or reinforcing particles increases, corrosion resistance decreases. Further, aluminum alloy materials having both abrasion resistance and high strength have not yet been developed. For example, a high strength alloy produced by a rapid-solidification method including gas atomizing is developed. However, this alloy is satisfied with strength characteristics, but it has been difficult to further impart to the alloy other properties such as abrasion resistance, in addition to strength characteristics. Further, gradient materials are proposed in which a mixing ratio of various alloys or particles is continuously changed therein, but such materials are still under investigation. Also, in cladding or co-extrusion method, which is a composite technique for a molten metal material, an entire surface of a first material is covered with a second material. Thus, even unnecessary parts are covered, and the characteristics of the first material cannot sufficiently be exhibited. This may be disadvantageous from the standpoint of costs. In addition, a method by welding such as brazing involves increase in the number of steps, making it difficult to shift the method to automation.

SUMMARY OF THE INVENTION

The present invention has been made in view of the above-mentioned disadvantages involved in the prior art techniques. Accordingly, an object of the present invention is to readily provide an alloy material having an advantageous combination of plural properties, such as high strength and abrasion resistance, etc., by maximally utilizing merits of a powder metallurgical method.

The present invention provides a shaped article formed from a consolidated powder material and having a plurality of excellent properties in combination as a whole by combining an abrasion resistant material, a self-lubricant material or the like with an aluminum alloy used as a base material in such an arrangement that the aluminum alloy has properties required in the intended use or is improved in such properties. More specifically, the present invention is directed to:

(1) A process for producing a shaped article, comprising:

preparing a first powder having high strength and rigidity after completion of forming, and a second powder having abrasion resistance and surface hardness after completion of forming;

compacting those powders to provide a forming material comprising a base part comprising the first powder and a supplemental part comprising the second powder; and forming the forming material into a shaped article by plastic processing in which the base part and the supplemental part have different characteristics.

(2) A process for producing a shaped article as defined in item (1), wherein the second powder is arranged on a surface of the first powder, and those powders are simultaneously compressed to form the forming material.

(3) A process for producing a shaped article as defined in item (1), wherein the first powder is consolidated with a cold isostatic press to form the base part, the second powder is placed on the surface of the base part, and those are compacted into the forming material.

(4) A process for producing a shaped article as defined in item (1), wherein the plastic processing is any one of extrusion, forging or rolling.

(5) A process for producing a shaped article as defined in item (1), wherein the first powder consists of at least one rapidly-solidified alloy powder consisting of a composition represented by any one of the following chemical formulae (I) to (IV).

(6) A process for producing a shaped article as defined in item (1), wherein the first powder consists of a quasi-crystal alloy powder consisting of a composition represented by the following formula (V).

(7) A process for producing a shaped article as defined in item (1), wherein the second powder consists of at least one member selected from the group consisting of $Al_2O_3$, $Si_3N_4$, BN, SiC, $Al_4C_3$, $Al_8B_2O_{15}$ and $B_2O$.

(8) A process for producing a shaped article as defined in item (1), wherein the second powder is a mixture of (a) at least one selected from the group consisting of a rapidly-solidified alloy powder consisting of a composition represented by any one of the following formulae (I) to (IV) and a quasi-crystal alloy powder consisting of a composition represented by the following formula (V) and (b) at least one alloy powder selected from the group consisting of $Al_2O_3$, $Si_3N_4$, BN, SiC, $Al_4C_3$, $Al_8B_2O_{15}$ and $B_2O$.

(9) A process for producing a shaped article as defined in item (1), wherein the first powder consists of at least one rapidly-solidified alloy powder consisting of a composition represented by any one of the following formulae (I) to (IV), and the second powder consists of a quasi-crystal alloy powder consisting of a composition represented by the following formula (V).

Rapidly-solidified alloy powder: General Formula:

$$Al_aM1_bX_e, \quad (I)$$

$$Al_aM1_{(b-c)}M2_cX_e, \quad (II)$$

$$Al_aM1_{(b-d)}M3_dX_e, \quad (III)$$

and $$Al_aM1_{(b-c-d)}M2_cM3_dX_e \quad (IV)$$

wherein:

M1: at least one element selected from the group consisting of Mn, Fe, Co, Ni and Mo;

M2: at least one element selected from the group consisting of V, Cr and W;

M3: at least one element selected from the group consisting of Li, Ca, Mg, Si, Cu and Zn;

X: at least one element selected from the group consisting of Nb, Hf, Ta, Y, Zr, Ti, Ag, rare earth elements and misch metal (hereinafter, referred to as "Mm") which is a mixture of rare earth elements; and a, b, c, d and e are, in atomic %, $75 \leqq a \leqq 97$, $0.5 \leqq b \leqq 15$, $0.1 \leqq c \leqq 5$, $0.5 \leqq d \leqq 5$, and $0.5 \leqq e \leqq 10$.

More preferably, the rapidly-solidified alloy powder has a structure comprising Al crystals having an average particle size of 0.005 to 1 $\mu$m, and intermetallic compound particles having an average particle size of 0.001 to 0.1 $\mu$m.

Ouasi-crystal alloy powder:

$$Al_{bal}M4_xM5_y \qquad \text{General Formula (V)}$$

wherein:

M4: at least one element selected from the group consisting of Mn, Cr, V, Mo and W;

M5: at least one element selected from the group consisting of Fe, Co, Ni, Cu, Zr, Mg, Ti, Hf, Si, Y, rare earth elements and Mm;

x and y are, in atomic %, $0.5 \leqq x10$ and $0.5 \leqq y10$. The quasi-crystal alloy powder contains at least one selected from the group consisting of quasi-crystals consisting of an icosahedral phase, a regular decagonal phase or a similar crystal phase akin thereto (hereinafter "approximant phase") in the range of 30 to 90% by volume.

The quasi-crystal alloy powder more preferably has a structure which comprises quasi-crystals having a particle size of 1 $\mu$m or less and Al crystals having an average particle size of 10 $\mu$m or less.

DETAILED DESCRIPTION OF THE PREFERRED EMBODIMENTS

Figure 1:
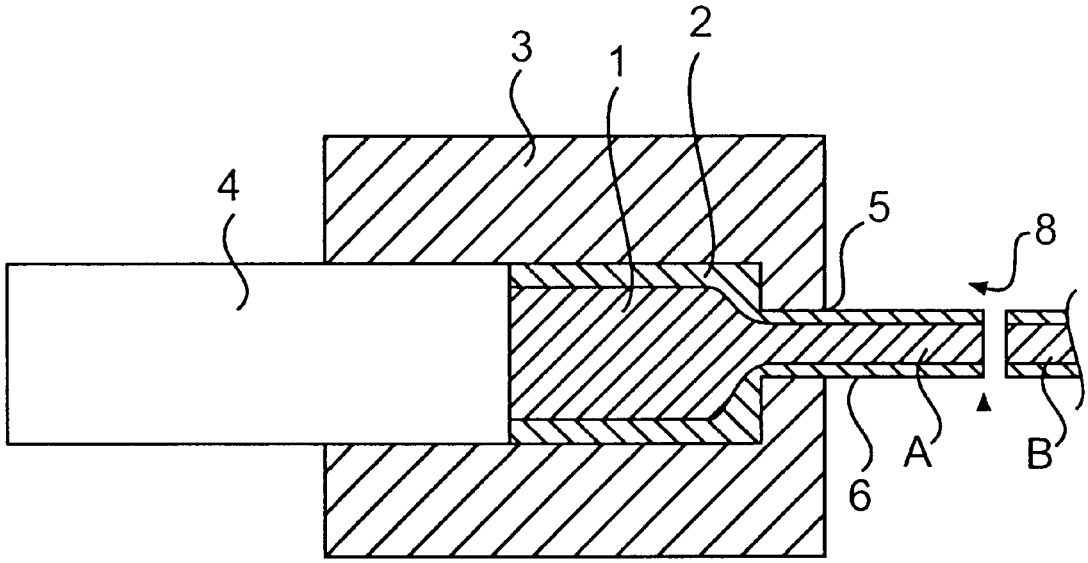
FIG. 1 is an explanatory view of an extrusion processing according to an example of the present invention.

The above-described rapidly-solidified alloy is obtained by quenching the alloy material having the above-specified composition, thereby forming an amorphous phase, a mixed-phase of an amorphous phase and a microcrystalline phase, a microcrystalline phase therein. Such an alloy material is suitable for use in high-speed forging and high speed rolling, which are conducted with a relatively high speed, and also has high strength. For example, the alloy material has a specific strength of 20 kgf/mm$^2$ or more, and a specific modulus of 2,700 kgf/mm$^2$ or more.

Further, it has been found in the course of investigation of the rapidly-solidified alloy powder that the quasi-crystal alloy powder can finely disperse quasi-crystals, which are known to be hard and strong, in the Al matrix in the similar manner. The Al alloy containing quasi-crystals is a material not only having high strength but also showing very large elongation.

In the conventional powder metallurgical method, in order to impart specific properties to a metal or an alloy, fibers or particles of ceramics, such as SiC, $Al_2O_3$, $Si_3N_4$ or BN, have been mixed with the metal or alloy to form a composite material. However, from the macroscopic standpoint, such a composite material has been considered to have a uniform structure.

The present invention enables a composite alloy to have both properties of strength and abrasion resistance by, for example, that a central portion of a material is made of an alloy for exhibiting-high strength and the whole or part of a surface portion of the material is made of an alloy for exhibiting abrasion resistance, and those alloys are combined.

The powder metallurgical method of an aluminum alloy is that an alloy powder is compressed (if necessary, sealed in a can; vacuum deaeration and heating are involved) to form an intermediate compact (forming material), the compact (forming material) is formed, for example, by extrusion and/or forging, if necessary followed by mechanical cooling, thereby obtaining a product (shaped product).

Upon compressing powders in the present invention, the first powder and the second powder are separately compacted, and those are combined; the first powder is compacted, and the second powder is arranged on an appropriate position of the compacted first powder; or different kinds of powders of the first powder and the second powder are arranged on, for example, a central portion, a surface portion and other specific portions (for example, the second powder is arranged on one side face, one edge portion, peripheral portion or other desired portion of a surface portion), and those are simultaneously compacted to provide a forming material. The forming material is subjected to plastic processing such as extrusion, forging or rolling, to form the objective product (shaped product). The kind, combination, size, thickness and the like of the used alloys are determined depending on the characteristics required from a product (shaped product), taking the kind of plastic processing into consideration.

A cold isostatic press is preferably used to form the base part from the first powder.

The present invention is described in more detail by the following examples, but the invention is not limited thereto.

EXAMPLE 1

An Al-Cr-Mn-Cu alloy powder was produced as a first powder with a gas atomizer. SiC particles having an average particle size of 3 $\mu$m were mixed in a proportion of 15 wt % with the same powder as the above first powder in a ball mill to produce a composite alloy powder as a second powder. The first powder and the second powder were filled in a mold having an inner diameter of 42 mm to prepare an extrusion billet. Those powders were filled such that the first powder constituted an inner portion having a diameter of 36 mm, and the second powder constituted a surface skin portion having a thickness of 3 mm. The powders filled were compressed with upper and lower stems of the mold at room temperature under a pressure of 550 MPa to obtain a compact having a length of 50 mm. This compact was heated to 350° C. with a high frequency induction heating, and then extruded by the system as shown in FIG. 1 at an extrusion ratio of 8 to obtain a square bar of about 8×22 mm. In FIG. 1, reference numeral 1 denotes a compact of the first powder; 2, a compact of the second powder; and 3, a container. These compacts were introduced into the container 3, and then extruded with a stem 4, and a square bar A is extruded from an opening 5. Reference numeral 6 denotes a surface skin portion. The resulting extrudated material was appropriately cut with a cutting blade 8 to obtain a shaped article B.

As a result of observing a cross section of the extruded material, it was found that a surface skin portion of the square bar was formed by SiC dispersed composite alloy in a thickness of 0.1–0.5 mm. A test piece for a tensile test according to JIS 14A was cut from this extruded material by a lathe processing, and was subjected to a strength test. As a result, the maximum strength was 490 MPa, the yield strength was 390 MPa, and the elongation was 10%. Those properties were the same as the properties of a material produced using only the first powder.

Subsequently a plate material was cut in a thickness of 3 mm from the surface skin of the extruded material, and three point-bending tests were conducted, with-the surface skin portion facing downwardly. As a result, separation of the surface skin portion was not observed, and it was found that the core portion and the surface skin portion were well bonded.

Next, a sample having a diameter of 5 mm and a length of 20 mm was cut from the extruded material so as to have the surface skin portion at the bottom, thus obtaining a pin. This pin was subjected to a pin-on-disk type abrasion test. The material of the disk was SKS3 (HRC 60±1), and other conditions were such that a load was 10 kgf, a friction speed was 1.25 m/s, and a frictional distance was 18,000 m (14.4 ks). Lubrication was not conducted. As a comparative example, a material was obtained by extruding the compact composed of only the first powder under the same conditions as above, and using this comparative material, the same abrasion test was conducted.

The test results obtained are shown in the Table 1 below.

TABLE 1

| | | Material of Example 1 | Material of Comparative Example |
|---|---|---|---|
| Abrasion loss ($\times 10^{-3}$ mm$^3$) | | 33.2 | 144.2 |
| Specific abrasion loss ($\times 10^{-7}$ mm$^2$/kgf) | | 1.8 | 8.0 |
| Disk | Abrasion loss ($\times 10^{-3}$ mm$^3$) | 1.4 | 29.5 |
| | Specific abrasion loss ($\times 10^{-7}$ mm$^2$/kgf) | 0.1 | 1.6 |

As is apparent from Table 1 above, the comparative material shows a specific abrasion loss of $8.0\times10^{-7}$ mm$^2$/kgf, whereas the material of Example 1 shows a specific abrasion loss of $1.8\times10^{-7}$ mm$^2$/kgf, which is about ¼ of the specific abrasion loss of the comparative material. Thus, it is apparent that the present invention greatly improves the abrasion resistance.

EXAMPLE 2

Using the same materials as used in Example 1, a round bar having a diameter of 8 mm was extruded at an extrusion ratio of 10 in the same manner as in Example 1. As a result of observing a cross section of the extruded material, it was found that the surface skin portion was formed of an SiC dispersed composite alloy in a thickness of 0.2–0.3 mm. A sample having a diameter of 8 mm and a length of 12 mm was cut from the extruded material, heated to 400° C., and subjected to an upsetting test at 400° C. in an atmosphere. As a result, crack and peeling were not observed on the surface skin portion composed of the composite alloy up to the reduction ratio of 50%, thus showing good forging formability.

As described above, according to the present invention, an aluminum alloy having a plurality of properties, such as high strength and abrasion resistance, in combination can easily be produced.

What is claimed is:

1. A process for producing a shaped article comprising:

preparing a first powder having high strength and rigidity after completion of forming, and a second powder having abrasion resistance and surface hardness after completion of forming;

compacting those powders to provide a forming material comprising a base part comprising the first powder and a supplemental part comprising the second powder; and forming the forming material into a shaped article by plastic processing in which the base part and the supplemental part have different characteristics, wherein the first powder consists of at least one rapidly-solidified alloy powder consisting of a composition represented by any one of the following formulae (I) to (IV):

$$Al_aM1_bX_e, \quad (I)$$

$$Al_aM1_{(b-c)}M2_cX_e, \quad (II)$$

$$Al_aM1_{(b-d)}M3_dX_e, \quad (III)$$

and $$Al_aM1_{(b-c-d)}M2_cM3_dX_e \quad (IV)$$

wherein:

M1: at least one element selected from the group consisting of Mn, Fe, Co, Ni and Mo;

M2: at least one element selected from the group consisting of V, Cr and W;

M3: at least one element selected from the group consisting of Li, Ca, Mg, Si, Cu and Zn;

X: at least one element selected from the group consisting of Nb, Hf, Ta, Y, Zr, Ti, Ag, rare earth elements and misch metal Mm which a mixture of rare earth elements; and a, b, c, d and e are, in atomic %, $75\leqq a\leqq 97$, $0.5\leqq b\leqq 15$, $0.1\leqq c\leqq 5$, $0.5\leqq d\leqq 5$, and $0.5\leqq e\leqq 10$.

2. A process for producing a shaped article comprising:

preparing a first powder having high strength and rigidly after completion of forming, and a second powder having abrasion resistance and surface hardness after completion of forming;

compacting those powders to provide a forming material comprising a base part comprising the first powder and a supplemental part comprising the second powder; and forming the forming material into a shaped article by plastic processing in which the base part and the supplemental part have different characteristics, wherein the first powder consists of a quasi-crystal alloy powder consisting of a composition represented by the following formula (V):

$$Al_{bal}M4_xM5_y$$

wherein:

M4: at least one element selected from the group consisting of Mn, Cr, V, Mo and W;

M5: at least one element from the group consisting of Fe, Co, Ni, Cu, Zr, Mg, Ti, Hf, Si, Y, rare earth elements and Mm;

x and y are, in atomic %, $0.5\leqq x\leqq 10$ and $0.5\leqq y\leqq 10$; and contains at least one selected from the group consisting of quasi-crystals consisting of an icosahedral phase, a regular decagonal phase or an approximant phase in the range of 30 to 90% by volume.

3. A process for producing a shaped article comprising:

preparing a first powder having high strength and rigidity after completion of forming, and a second powder having abrasion resistance and surface hardness after completion of forming;

compacting those powders to provide a forming material comprising a base part comprising the first powder and a supplemental part comprising the second powder; and forming the forming material into a shaped article by plastic processing in which the base part and the supplemental part have different characteristics, wherein the second powder is at least one member selected from the group consisting of $Al_2O_3$, $Si_3N_4$, BN, SiC, $Al_4C_3$, $Al_8B_2O_{15}$ and $B_2O$.

4. A process for producing a shaped article comprising:

preparing a first powder having high strength and rigidity after completion of forming, and a second powder having abrasion resistance and surface hardness after completion of forming;

compacting those powders to provide a forming material comprising a base part comprising the first powder and a supplemental part comprising the second powder; and forming the forming material into a shaped article by plastic processing in which the base part and the supplemental part have different characteristics, wherein the second powder is a mixture of (a) at least one selected from the group consisting of rapidly-solidified alloy powders each consisting of a composition represented by any one of the following formulae (I) to (IV) and a quasi-crystal alloy powder consisting of a composition represented by the formula (V):

$$Al_aM1_bX_e, \quad (I)$$

$$Al_aM1_{(b-c)}M2_cX_e, \quad (II)$$

$$Al_aM1_{(b-d)}M3_dX_e, \quad (III)$$

and $$Al_aM1_{(b-c-d)}M2_cM3_dX_e \quad (IV)$$

wherein:

M1: at least one element selected from the group consisting of Mn, Fe, Co, Ni and Mo;

M2: at least one element selected from the group consisting of V, Cr and W;

M3: at least one element selected from the group consisting of Li, Ca, Mg, Si, Cu and Zn;

X: at least one element selected from the group consisting of Nb, Hf, Ta, Y, Zr, Ti, Ag, rare earth elements and Mm; and a, b, c, d and e are, in atomic %, $75 \leqq a \leqq 97$, $0.5 \leqq b \leqq 15$, $0.1 \leqq c \leqq 5$, $0.5 \leqq d \leqq 5$, and $0.5 \leqq e \leqq 10$, $$Al_{bal}M4_xM5_y \quad (V)$$

wherein:

M4: at least one element selected from the group consisting of Mn, Cr, V, Mo and W;

M5: at least one element selected from the group consisting of Fe, Co, Ni, Cu, Zr, Mg, Ti, Hf, Si, Y, rare earth elements and Mm;

x and y are, in atomic %, $0.5 \leqq x \leqq 10$ and $0.5 \leqq y10$;

said quasi-crystal alloy powder containing at least one selected from the group consisting of quasi-crystals consisting of an icosahedral phase, a regular decagonal phase or an approximant phase in the range of 30 to 90% by volume, and (b) at least one alloy powder selected from the group consisting of $Al_2O_3$, $Si_3N_4$, BN, SiC, $Al_4C_3$, $Al_8B_2O_{15}$ and $B_2O$.

5. A process for producing a shaped article comprising:

preparing a first powder having high strength and rigidity after completion of forming, and a second powder having abrasion resistance and surface hardness after completion of forming;

compacting those powders to provide a forming material comprising a base part comprising the first powder and a supplemental part comprising the second powder; and forming the forming material into a shaped article by plastic processing in which the base part and the supplemental part have different characteristics, wherein the first powder is at least one rapidly-solidified alloy powders each consisting of a composition represented by any one of the following formulae (I) to (IV):

$$Al_aM1_bX_e, \quad (I)$$

$$Al_aM1_{(b-c)}M2_cX_e, \quad (II)$$

$$Al_aM1_{(b-d)}M3_dX_e, \quad (III)$$

and $$Al_aM1_{(b-c-d)}M2_cM3_dX_e \quad (IV)$$

wherein:

M1: at least one element selected from the group consisting of Mn, Fe, Co, Ni and Mo;

M2: at least one element selected from the group consisting of V, Cr and W;

M3: at least one element selected from the group consisting of Li, Ca, Mg, Si, Cu and Zn;

X: at least one element selected from the group consisting of Nb, Hf, Ta, Y, Zr, Ti, Ag, rare earth elements and Mm; and a, b, c, d and e are, in atomic %, $75 \leqq a \leqq 97$, $0.5 \leqq b \leqq 15$, $0.1 \leqq c \leqq 5$, $0.5 \leqq d \leqq 5$, and $0.5 \leqq e \leqq 10$, and the second powder is a quasi-crystal alloy powder consisting of a composition represented by the formula (V):

$$Al_{bal}M4_xM5_y \quad (V)$$

wherein:

M4: at least one element selected from the group consisting of Mn, Cr, V, Mo and W;

M5: at least one element selected from the group consisting of Fe, Co, Ni, Cu, Zr, Mg, Ti, Hf, Si, Y, rare earth elements and Mm;

x and y are, in atomic %, $0.5 \leqq x \leqq 10$ and $0.5 \leqq y10$;

said quasi-crystal alloy powder containing at least one selected from the group consisting of quasi-crystals consisting of an icosahedral phase, a regular decagonal phase or an approximant phase in the range of 30 to 90% by volume.

6. The process for producing a shaped article as claimed in claim 1, 2, 3, 4 or 5, wherein the second powder is arranged on a surface of the first powder, and those powders are simultaneously compressed to form the forming material.

7. The process for producing a shaped article as claimed in claim 1, 2, 3, 4 or 5, wherein the first powder is consolidated by cold isostatic press to form the base part, the second powder is placed on the surface of the base part, and those are compacted to provide the forming material.

8. The process for producing a shaped article as claimed in claim 1, 2, 3, 4, or 5, wherein the plastic processing is any one of extrusion, forging or rolling.

* * * * *

UNITED STATES PATENT AND TRADEMARK OFFICE

CERTIFICATE OF CORRECTION

PATENT NO. : 6,274,082 B1
DATED : August 14, 2001
INVENTOR(S) : Junichi Nagahora, Koju Tachi and Koji Saito It is certified that error appears in the above-identified patent and that said Letters Patent is hereby corrected as shown below:

Title page,
Item [57], ABSTRACT, lines 16-17, "a different compositions" should read -- a different composition --.

Column 6, claim 1,
Line 24, "which a mixture" should read -- which is a mixture --.

Column 6, claim 2,
Line 29, "rigidly" should read -- rigidity --.
Line 48, after "element", insert -- selected --.

Column 7, claim 4,
Line 53, "0.5≦y10" should read -- 0.5≦y≦10 --.

Column 8, claim 5,
Line 8, "powders each" should read -- powder --.
Line 47, "0.5≦y10" should read -- 0.5≦y≦10 --.

Signed and Sealed this

Sixteenth Day of April, 2002

*Attest:*

*Attesting Officer*

JAMES E. ROGAN
*Director of the United States Patent and Trademark Office*